US005524466A

United States Patent [19]

Coe

[11] Patent Number: 5,524,466

[45] Date of Patent: Jun. 11, 1996

[54] METHOD AND APPARATUS FOR HYDRO-FORMING THIN-WALLED WORKPIECES

[75] Inventor: Thomas D. Coe, Boxford, Mass.

[73] Assignee: QA Technology Company, Inc., Hampton, N.H.

[21] Appl. No.: 501,428

[22] Filed: Jul. 12, 1995

Related U.S. Application Data

[63] Continuation of Ser. No. 236,368, Apr. 29, 1994, abandoned.

[51] Int. Cl.[6] ..... B21D 26/02

[52] U.S. Cl. ..... 72/62; 72/370

[58] Field of Search ..... 72/56, 58, 61, 72/62, 370, 60; 29/421.1

[56] References Cited

U.S. PATENT DOCUMENTS

| | | | |
|---|---|---|---|
| 1,448,457 | 3/1923 | Liddell . | |
| 3,320,784 | 5/1967 | Heeren et al. | 72/62 |
| 3,526,020 | 9/1970 | Lemelson | 72/62 |
| 3,698,221 | 10/1972 | Couland | 72/62 |
| 4,392,292 | 7/1983 | Irons . | |
| 4,513,497 | 4/1985 | Finch | 72/62 |
| 4,557,128 | 12/1985 | Costabile . | |
| 4,788,843 | 12/1988 | Seaman et al. . | |
| 4,827,605 | 5/1989 | Krips et al. . | |
| 4,928,509 | 5/1990 | Nakamura . | |
| 5,022,135 | 6/1991 | Miller et al. . | |
| 5,115,654 | 5/1992 | Swars et al. . | |

FOREIGN PATENT DOCUMENTS

| | | | |
|---|---|---|---|
| 1332461 | 10/1973 | United Kingdom | 72/62 |

*Primary Examiner*—David Jones

*Attorney, Agent, or Firm*—Davis, Bujold & Streck

[57] ABSTRACT

A method and apparatus for hydro-forming desired features into the walls of thin-walled objects such as small tubes. A mold is provided having an internal surface that is sized and shaped to support the wall of the tubing or other workpiece and defines cavities that correspond to the desired features. A fluid filled hollow needle having no O-rings or seals thereon is provided that has at least one opening therein for supplying hydraulic fluid under pressure to the inside surface of the tubing. The needle has an outer diameter that is smaller than the inner diameter of the tubing to form a small clearance therebetween when the needle is in the tubing. The clearance is sized to prevent any substantial leakage of fluid from the needle and provide a pressure drop in the clearance sufficient to maintain the pressure of the fluid, at the portions of the wall to be deformed, high enough to deform the wall, while also facilitating insertion and removal of the needle into and from the tubing. The needle is inserted into the tubing and a pulse of hydraulic pressure is applied to the fluid inside the needle for transmission through the opening(s) in the needle to the inner surface of the tubing to deform the wall of the tubing into the cavities in the mold to form the features on the tubing.

15 Claims, 2 Drawing Sheets

METHOD AND APPARATUS FOR HYDRO-FORMING THIN-WALLED WORKPIECES

This is a continuation of application Ser. No. 08/236,368, filed on Apr. 29, 1994, now abandoned.

FIELD OF THE INVENTION

This invention relates to hydro-forming tubing into a desired external configuration, in particular, to a method and apparatus for hydro-forming small tubing that is suitable for mass production.

BACKGROUND OF THE INVENTION

It is known in the prior art to hydro-form tubing or thin walled containers into a desired external configuration. In the prior art methods the tubing or container is enclosed in a die having an internal configuration that corresponds to the external configuration of the tubing or container to be formed. The inner surface of the die mates with and abuts against the outer surface of the portion of the tubing or the container to be formed thereby securely holding the tubing or container in place. Cavities are located in the inner surface of the container and are located and shaped to correspond to the desired external configuration of the tubing or container. In this way, the inner surface of the die supports the tubing or container where there is to be no forming of the wall(s) of the tubing or container, and the portions of the wall(s) that are to be deformed overlie the cavities and are unsupported by the die.

When pressurized hydraulic fluid is applied to the interior of the tubing or container, the pressurized fluid presses against the interior surface of the wall(s) of the tubing or container and the unsupported portions of the wall(s) are deformed outward into the cavities. Thus the wall(s) are deformed by the pressurized fluid into the desired configuration.

In one prior art method of supplying the pressurized fluid to the interior of the tubing, the ends of the tubing are held in place and sealed fluid tight by holders, one of which has a supply channel therein for supplying hydraulic fluid to the interior of the tubing. This method requires a tight fit between the holders and the tubing necessitating careful insertion of the holders into the die or tubing. A relatively large amount of hydraulic fluid is also required to fill the tubing before the fluid can be pressurized to deform the tubing wall. These two drawbacks considerably slow down the process making it unsuitable for mass production.

Another prior art method attempts to alleviate the need to fill the tubing with fluid of the above prior art method by inserting an hydraulic fluid filled probe or needle that has a fluid supply passage therein into the tubing or container. Holes are arranged in the sides of the needle to supply pressurized fluid directly to the portions of the wall(s) to be deformed when the needle is fully inserted into the tubing. According to this method, O-rings are mounted on the needle adjacent either side of each opening sealing the fluid in the area immediately around the opening and the portion of the tubing to be deformed.

This arrangement eliminates the need to fill the entire tube or container with pressurized fluid. The fluid is supplied directly to the portions of the wall to be deformed and is sealed in a very small space around the portions to be deformed by the 0-rings. Therefore, a pulse of pressurized fluid is sufficient to deform the wall(s) of the tubing or container saving the time required to fill the tubing with fluid greatly speeding up the actual deformation process itself. The prior art is not applicable to miniature tubing with inside diameters of as little as 2 mm or less. If "O" rings are used, the needle must be reduced in cross-section at the "O" ring locations, rendering it very fragile both to insertion stresses and the hydraulically induced stresses during the forming process. Also the "O" rings are vulnerable to rapid wear in production due to variable surface quality of the tubing inside surface and there is the practical problem of finding or making "O" rings in these miniature sizes which will tolerate the forming pressure required. If the needle is forced into the tubing with no "O" rings as an interference fit, the resulting stresses in the needle will in most cases cause the needle to buckle as an overloaded column and break.

SUMMARY OF THE INVENTION

The present invention solves the above problems by providing a needle for insertion into small tubing to supply pressurized hydraulic fluid through holes in the side of the needle to the portions of the tubing wall to be deformed. The needle according to the present invention has no O-rings thereon and is sized to allow a sufficient clearance between the needle and the tubing to facilitate ease of insertion of the needle into the tubing, greatly enhancing the speed and reliability of the process thereby making it suitable for mass production. At the same time, the clearance is small enough that the pressure drop along the outside of the needle between the tubing and the needle is sufficient to maintain the pressure of the fluid, at the portions of the tubing wall to be deformed, high enough to deform the tubing wall and to prevent any substantial leakage of fluid through the clearance.

According to the invention there is provided a process of hydro-forming a shape feature into a wall of an object comprising the steps of placing a first surface of the wall against a surface shaped to substantially correspond to a negative relief of the wall with the feature formed therein; locating a fluid pressure supply device adjacent a second surface of the wall, opposite the first surface, the device being sized and shaped to define a clearance, when so located, between the device and the second surface, the clearance being small enough to, by itself, to provide a pressure drop in the clearance sufficient to maintain the pressure of the fluid, at the portions of the wall to be deformed, high enough to deform the wall during the hydro-forming; and applying fluid pressure through the device to hydro-form the feature.

Also according to the invention there is provided a method for hydro-forming a wall of a workpiece, the wall having first and second opposed faces, comprising the steps of supporting the first face of the wall against a work supporting surface have at least one cavity configured to define a desired feature of the wall; placing a hollow member adjacent the second face of the wall, the hollow member having at least one opening therein to supply fluid from inside the member to the workpiece adjacent the cavity; applying a fluid through the opening under sufficient pressure and for a sufficient period, to the second face of the wall to hydro-form the desired feature, against the cavity, in the wall of the workpiece; and maintaining a clearance between the member and the second face of the wall, the clearance being sized to provide a sufficient pressure drop sufficient to maintain the pressure of the fluid, at the portions of the wall to be deformed, high enough to deform the wall during the hydro-forming of the feature while facilitating said placement and removal of the member to and from said adjacency.

Also according to the invention there is provided a process for hydraulically forming cylindrical tubing into a desired shape, comprising the steps of providing a segmented forming die having a bore sized to receive and support the tubing with an entry in at least one end of the bore and a cavity in an inner surface of the bore configured to define a desired shape to be formed in the tubing; providing a hollow needle having an external diameter that is smaller than an internal diameter of the tubing whereby the needle fits in the tubing with a clearance, between an inner surface of the tubing and an outer surface of the needle, sufficiently small to provide a pressure drop, in the clearance, sufficient to maintain the pressure of the fluid, at the portions of the wall to be deformed, high enough to deform the wall, during said forming, while being sufficiently large to facilitate insertion and removal of the needle, the needle defining an opening to allow application of fluid under pressure from inside the needle to the inner surface of the tubing adjacent the cavity; positioning the tubing within the die; inserting the needle into the tubing; applying sufficient pressure to fluid in the needle for a sufficient duration to apply pressure through the opening to deform the tubing into the cavity to form the desired shape; and removing the needle from the tubing and removing the tubing from the segmented die.

Also according to the invention there is provided an apparatus for hydro-forming a workpiece having a wall defined by first and second opposed surfaces, comprising a die having an interior sized and shaped to receive and closely support the first surface of the wall, the interior having a recess in an inner surface thereof configured to correspond to a desired configuration of the wall; a fluid supply member, having an opening therein to allow communication of fluid from inside the member to the second surface of the workpiece adjacent the recess, the member being insertable in the tubing and being sized and shaped to define a clearance between the member and the tubing, at least adjacent the cavity, when the member is in place in the tubing, the clearance being small enough, by itself, to provide a pressure drop in the clearance sufficient to maintain the pressure of the fluid, at the portions of the wall to be deformed, high enough to deform the wall during the hydro-forming, the clearance, at the same time, being sufficient to facilitate insertion and removal of the needle to and from the tubing.

BRIEF DESCRIPTION OF THE DRAWINGS

The invention will now be described, by way of example, with reference to the accompanying drawings, in which.

DETAILED DESCRIPTION

Figure 1:
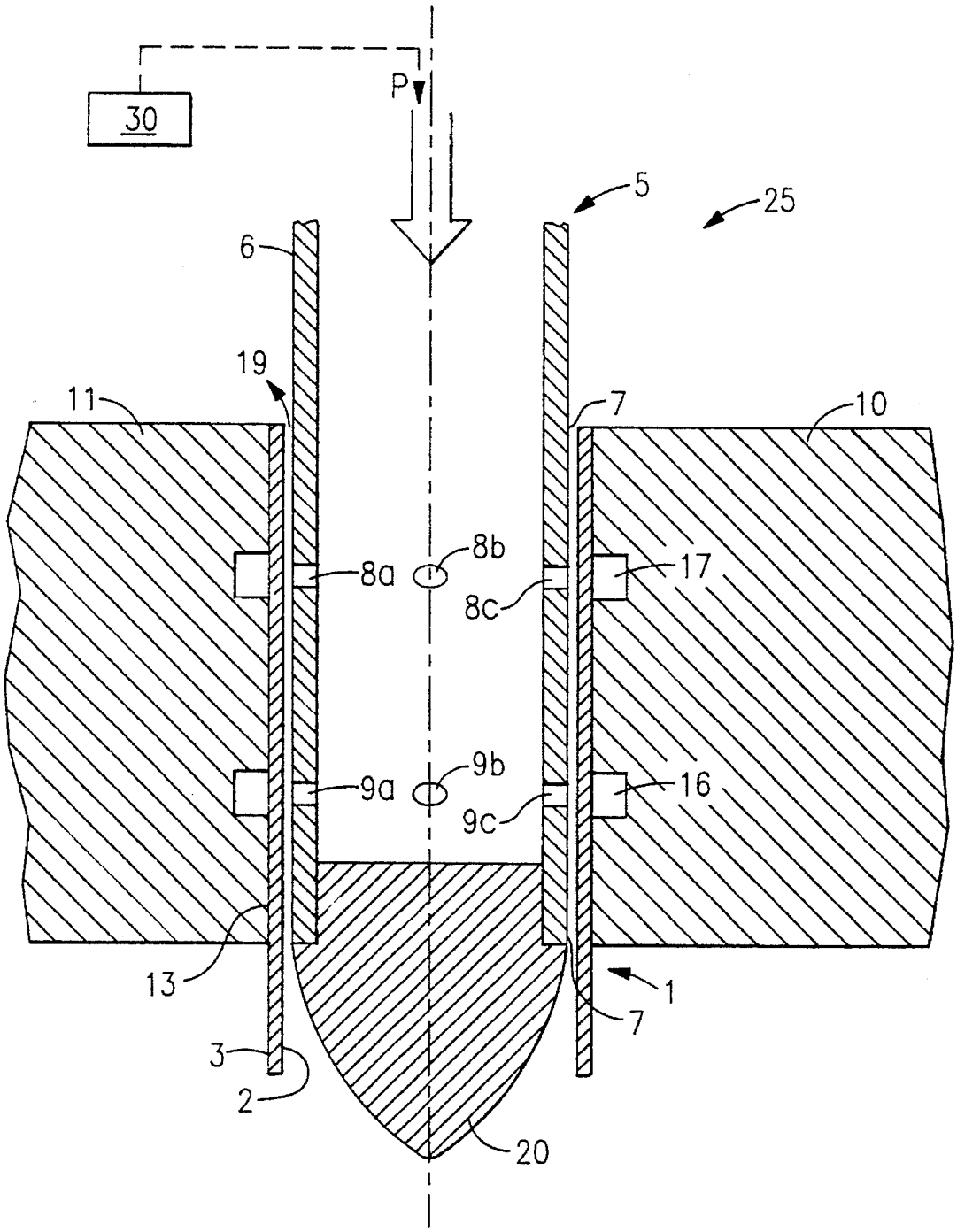
FIG. 1 is a diagrammatic cross-sectional view of a hydro-forming apparatus according to the invention with the needle inserted in the tubing before the tubing is deformed.

An hydro-forming apparatus, according to the invention, for hydro-forming tubing 1 into a desired external configuration is generally indicated as number 25 in FIG. 1. It can be appreciated that the tubing can have any shaped cross section desired, e.g. round, square, triangular etc. Likewise, the size and shape of the cross-section of the tubing may vary along the length of the tubing and the tubing may be enclosed at one end. As used herein, "tube" or "tubing" shall be construed to include these variations. The hydro-forming apparatus 25, includes a segmented die 10, 11, a hollow hydraulic fluid filled needle 5, and a means 30 for applying pressure to the fluid in the needle as indicated by arrow P.

The internal surface 13 of the segmented die 10, 11 defines a bore that is sized and shaped to receive and support the simple cylindrical tubing 1 to be formed therein. The die is preferably a split die having two die halves 10 and 11. However, it can be appreciated that the die could be formed of multiple parts so that it can be closed on thin walled containers or other thin walled objects having a more complex three dimensional shape than the tubing 1 shown in the Figures.

Figure 2:
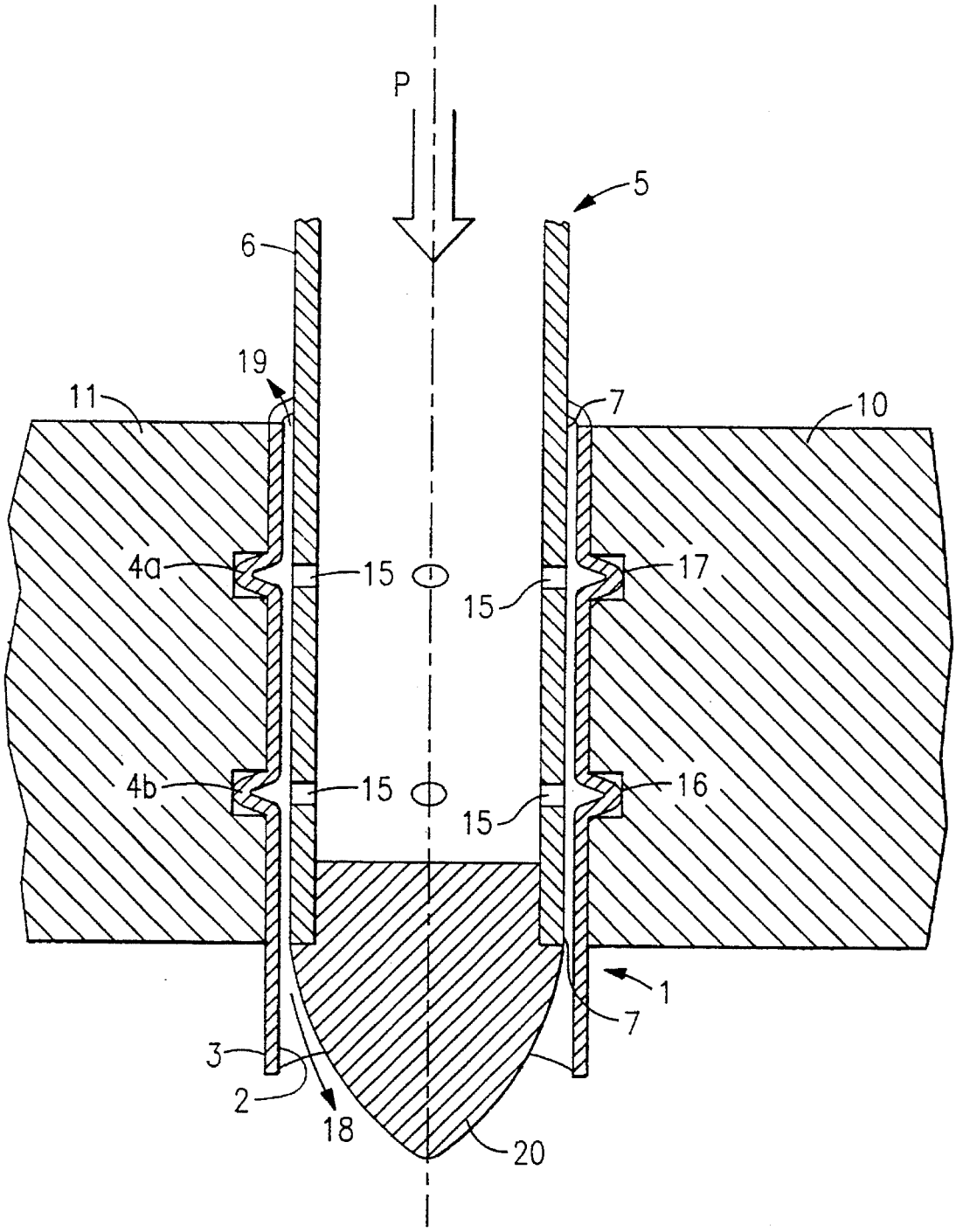
FIG. 2 is a diagrammatic cross-sectional view of an apparatus as in FIG. 1 after the tubing is deformed.

Cavities 16 and 17 are located in the interior surface 13 of the die. The size, shape and configuration of the cavities 16 and 17 correspond to the desired size, shape and configuration of the desired external surface 3 of the tubing. FIG. 1 shows two annular cavities 16, 17 that circumvent the inner surface 13 of the die 10, 11 for forming two annular outwardly extending concentric rings or annuli (4*a* and 4*b* as shown in FIG. 2) on the external surface 3 of the tubing 1. It can be appreciated that there can be any number of cavities having various sizes and configurations depending on the desired external configuration of the tubing 1.

FIG. 1 shows tubing 1 to be formed disposed in the bore formed by the die halves 10, 11. Where the tubing 1 is not to be deformed the outer surface 3 of the tubing 1 is supported by the internal surface 13 of the die. On the other hand, where the tubing 1 is to be deformed, forming external features thereon, the tubing 1 overlies a cavity 16, 17 and is unsupported.

A hollow needle 5 that is filled with hydraulic fluid, preferably oil, is shown in FIG. 1 inserted into the tubing 1. The needle 5 has a generally conical tip 20 that plugs and seals the end of the needle 5. The generally conical shape of the tip 20 facilitates insertion of the needle 5 into the tubing 1. Openings 8*a–c* and 9*a–c* extend through the side wall of the needle and are located opposite the cavities 16 and 17 when the needle is inserted in the tubing 1 as shown in FIG. 1. In this way, the openings 8*a–c*, 9*a–c* supply pressurized fluid from within the needle 5 directly to the inner surface 2 of the tubing where the tubing 1 is to be deformed.

In the drawings three openings 8*a–c* and 9*a–c* are shown for each annulus 4*a*, and 4*b* to be formed in the tubing 1. The number of openings can vary from application to application. However, the holes need to be large enough to freely transmit the pressure pulse through the opening to the inner surface of the workpiece and the walls of the needle need to be strong enough to endure many cycles without breaking.

If there are too many holes around the circumference of the needle, the needle will be weakened and will break after only a relatively few cycles. On the other hand, if the holes are too small or too few, the pressure drop from inside the needle to outside the needle will be too large and either the tubing will fail to be deformed or an impractically large pulse of pressure will be required to deform the tubing. It has been found that two to four holes of a sufficient size are preferable to form a ring in the tubing.

The needle 5 has an external diameter that is smaller than the internal diameter of the tubing 1 so that there is a small clearance 7 between the outer surface 6 of the needle and the inner surface 2 of the tubing forming a cylindrical space therebetween. The clearance 7 facilitates the rapid insertion of the needle 5 into the tubing 1 by allowing for a slight misalignment between the needle and the tubing and by allowing the needle to freely slide into and out of tubing 1.

It has been discovered that sufficient clearance for needle insertion can be provided with a clearance that is small enough to ensure that the pressure of the fluid, at the portions of the wall to be deformed, is high enough to deform the wall and to prevent any substantial leakage of fluid through the clearance 7. Thus the clearance is selected such that the pressure drop along the cylindrical space between the tubing 1 and the needle 5 is sufficiently high to maintain the desired fluid pressure in the clearance 7 when pressure is applied to fluid in the needle to deform the tubing. The small degree of leakage that does occur provides lubrication of the system, further easing insertion of the needle.

To hydro-form tubing with the apparatus described above, first the die halves 10, 11 are separated opening the die. The tubing 1 to be deformed is then positioned between the die halves 10, 11 and the die halves are closed upon the tubing 1 securely holding and supporting the tubing therebetween. Next, the fluid filled needle 5 is inserted into the tubing 1 to the appropriate depth with the openings 8*a–c* and 9*a–c* opposite the cavities 16, 17. A pulse of pressurized fluid is then supplied to the needle 5. The various means for supplying a pulse of pressurized fluid are well known in the art and are not described here. The pressure pulse is of sufficient pressure and duration to deform the wall of the tubing into the cavities forming annular rings 4*a* and 4*b* on the external surface 3 of the tubing 1 as shown in FIG. 2. Finally, the needle is removed from the tubing, the die is opened and the tubing is removed from the die.

By way of example, beryllium copper tubing having an inner diameter of 0.79 millimeter (0.031 inch) and an outer diameter of 0.94 millimeters (0.037 inches) can be hydro-formed according to the present invention using a pulse of pressure having a magnitude of 1725 bars (25,000 psi) and a duration of 50 milliseconds. However, it can be appreciated that the magnitude and duration of the pulse will depend upon the material, shape and thickness of the workpiece.

The provision of the clearance 7 and the conical tip 20 greatly facilitates the insertion of the needle 5 into the tubing 1. Thus, the insertion of the needle, and therefore the entire process, can be performed more quickly than in the prior art devices and methods. Therefore, the present invention is better suited for mass production with computerized equipment than the prior art. A complete cycle for producing two annular deformations, as shown in the figures, in the beryllium copper tubing described above, has been carried out in 400 milliseconds on a semi-automatic apparatus, demonstrating the potential of the present method and apparatus for mass production.

What is claimed is:

1. A process of hydro-forming a shape feature into a wall of an object comprising the steps of:

placing a first surface of the wall against a support surface having at least one cavity therein sized and shaped to substantially correspond to a negative relief of the wall with the feature formed therein;

providing a fluid pressure supply device having a forming surface;

locating said pressure supply device with said forming surface adjacent a second surface of the wall, opposite the first surface, such that said forming surface is spaced from said second surface, the forming surface being sized and shaped to define a clearance, when so located, between the device and the second surface that is open to an external atmosphere, the clearance being small enough to, by itself, provide a pressure drop in the clearance sufficient to maintain the pressure of the fluid, at the portions of the wall to be deformed, high enough to deform the wall during the hydro-forming; and applying fluid pressure through the device, while maintaining said spacing and maintaining said clearance between the forming surface and the second surface open to said atmosphere, to hydro-form the feature.

2. A process of hydro-forming according to claim 1 wherein the device and wall are moved laterally relative to one another during movement to and from the location of the device adjacent the wall and the clearance is sufficient to facilitate such lateral movement.

3. A method for hydro-forming a wall of a workpiece, the wall having first and second opposed faces, comprising the steps of:

(a) supporting the first face of the wall against a work supporting surface having at least one cavity configured to define a desired protruding feature on the first surface of the wall;

(b) placing a hollow member adjacent to and spaced from the second face of the wall defining a clearance between the hollow member and the second face of the wall that is open to an external atmosphere, the hollow member having at least one opening therein to supply fluid from inside the member to the workpiece adjacent the cavity;

(c) applying a fluid through the opening under sufficient pressure and for a sufficient period, to the second face of the wall to hydro-form the desired feature, against the cavity, in the wall of the workpiece; and (d) maintaining said clearance between the member and the second face of the wall open to said atmosphere, the clearance being sized to provide sufficient pressure drop to maintain the pressure of the fluid, at the portions of the wall to be deformed, high enough to deform the wall during the hydro-forming of the feature while facilitating said placement and removal of the member to and from said adjacency.

4. A process for hydraulically forming cylindrical tubing into a desired shape, comprising the steps of:

(a) providing a forming die having a bore sized to receive and support the tubing with an entry in at least one end of the bore and a cavity in an inner surface of the bore configured to define a desired protruding shape to be formed in an outer peripheral surface of the tubing;

(b) providing a needle having an external diameter that is smaller than an internal diameter of the tubing whereby the needle fits in the tubing with a clearance, between an inner surface of the tubing and an outer surface of the needle, that is open to an external atmosphere and sufficiently small to provide a pressure drop, in the clearance, sufficient to maintain the pressure of the fluid, at the portions of the tubing to be deformed, high enough to deform the tubing, during said forming, while being sufficiently large to facilitate insertion and removal of the needle, the needle defining an opening to allow application of fluid under pressure from inside the needle to the inner surface of the tubing adjacent the cavity;

(c) positioning the tubing within the die;

(d) inserting the needle into the tubing forming said clearance;

(e) applying sufficient pressure to fluid in the needle for a sufficient duration to apply pressure through the opening to deform the tubing into the cavity to form the desired shape while maintaining said clearance open to said atmosphere; and (f) removing the needle from the tubing and removing the tubing from the die.

5. A process according to claim 4, comprising facilitating insertion of the needle into the tubing by means of a generally cone shaped plug sealingly located in an end of the needle to close the end.

6. A process according to claim 4, wherein the pressure has a magnitude of about 1750 bars (25,000 psi) and a duration of about 50 milliseconds.

7. A process according to claim 4, wherein the die is a split die and the tubing is inserted into the die by placing the tubing between the die halves when they are open and then closing the die upon the tubing; and the tubing is removed from the die by opening the die halves and then removing the tubing from therebetween.

8. A process according to claim 4, wherein step (b) comprises providing a needle that is smaller than the internal diameter of tubing having an internal diameter of 2 mm or less.

9. A process according to claim 4, wherein step (a) comprises providing a forming die having a bore sized to receive and support tubing having an outer diameter of about 0.94 mm; and step (b) comprises providing a needle having an outer diameter that is smaller than the internal diameter of tubing having an internal diameter of about 0.7 mm.

10. An apparatus for hydro-forming tubing, having a wall defined by an outer peripheral first surface and an inner peripheral second surfaces, to form a desired shaped feature in the wall, comprising:

a die having an interior sized and shaped to receive and closely support the first surface of the wall, the interior having a recess in an inner surface thereof configured to correspond to said desired feature;

a hollow fluid supply needle, having an opening therein to allow communication of fluid from inside the needle to the second surface of the tubing adjacent the recess, the needle being insertable in the tubing and being sized and shaped to define a clearance between the needle and the second surface of the wall, when the needle is in place in the tubing, that is open to an external atmosphere, the clearance being small enough to, by itself, provide a pressure drop in the clearance sufficient to maintain the pressure of the fluid, at the portions of the wall to be deformed, high enough to deform the wall during the hydro-forming, while, at the same time, the clearance being sufficient to facilitate insertion and removal of the needle to and from the tubing.

11. An apparatus as in claim 10, wherein said hollow needle has a generally cone shaped plug sealingly located in an end thereof to close the end and facilitate insertion of the needle into the tubing.

12. An apparatus as in claim 10, wherein the die is a split die having at least two die parts defining the interior when closed.

13. An apparatus as in claim 10, comprising a means for applying pressure, to fluid in the needle, of sufficient magnitude and duration to deform the tubing into the recess to hydro-form the desired feature.

14. An apparatus as in claim 10, wherein said needle has an outer diameter sized to form said clearance in tubing having an inner diameter of 2 mm or less.

15. An apparatus according to claim 10, wherein the interior of said die is sized and shaped to receive and closely support tubing having an outer diameter of about 0.94 mm; and said needle has an outer diameter sized to form said clearance in tubing having an inner diameter of about 0.7 mm.

* * * * *